US005768806A

United States Patent [19]

Parisotto

[11] Patent Number: 5,768,806

[45] Date of Patent: Jun. 23, 1998

[54] SHOE SOLE

[75] Inventor: Davide Parisotto, Via Enrico Fermi, Italy

[73] Assignee: Calzaturificio S.C.A.R.P.A., Asolo, Italy

[21] Appl. No.: 888,788

[22] Filed: Jul. 7, 1997

Related U.S. Application Data

[63] Continuation of Ser. No. 597,260, Feb. 6, 1996, abandoned.

[30] Foreign Application Priority Data

Feb. 7, 1995 [IT] Italy ..... TO95 A 000077

[51] Int. Cl.[6] ..... A43B 13/18

[52] U.S. Cl. ..... 36/103; 36/28; 36/102

[58] Field of Search ..... 36/102, 103, 3 B, 36/30 R, 32 R, 28, 25 R, 35 R

[56] References Cited

U.S. PATENT DOCUMENTS

| | | | |
|---|---|---|---|
| 2,981,011 | 4/1961 | Lombardo | 36/28 X |
| 3,087,261 | 4/1963 | Russell | 36/28 |
| 3,087,262 | 4/1963 | Russell | 36/28 |
| 3,127,217 | 3/1964 | Colman | 36/28 |
| 3,205,595 | 9/1965 | Funck | 36/30 R X |
| 4,020,569 | 5/1977 | Fukuoka | 36/30 R X |
| 4,133,118 | 1/1979 | Khalsa | 36/29 X |
| 4,546,556 | 10/1985 | Stubblefield | 36/32 |
| 4,663,865 | 5/1987 | Telecemian | 36/114 |
| 5,189,816 | 3/1993 | Shibata | 36/28 |

FOREIGN PATENT DOCUMENTS

| | | |
|---|---|---|
| 0185781A1 | 12/1984 | European Pat. Off. . |
| 408793 | 1/1991 | European Pat. Off. . |
| 54936 | 4/1950 | France . |
| 2508779 | 1/1983 | France . |
| 2610076 | 9/1977 | Germany . |
| 1512246 | 8/1975 | United Kingdom . |
| 1444091 | 7/1976 | United Kingdom . |
| 2152797 | 5/1984 | United Kingdom . |
| 2152797 | 8/1985 | United Kingdom . |
| 81/01234 | 5/1981 | WIPO . |
| WO8303528 | 4/1993 | WIPO . |

OTHER PUBLICATIONS

British Patent Office Search Report.

*Primary Examiner*—Ted Kavanaugh
*Attorney, Agent, or Firm*—Evenson, McKeown, Edwards & Lenahan, PLLC

[57] ABSTRACT

A shoe sole presenting a rear portion in turn presenting at the top a number of inclined, flexible transverse ribs defining a deformable heel support.

6 Claims, 1 Drawing Sheet

SHOE SOLE

This is a continuation application of Ser. No. 08/597,260, filed on Feb. 6, 1996, now abandoned.

BACKGROUND OF THE INVENTION

The present invention relates to a shoe sole, in particular for sports shoes such as hiking boots, or for casuals or walking shoes.

Sports shoes are known to feature soles made of rubber and comprising, integrally, a front or toe portion, and a rear or heel portion, which is generally higher than the front portion to define a raised heel supporting surface.

To reduce the weight of the shoe, the rear portion is frequently hollow at the top, and the cavity defined by the raised edge houses a number of transverse and longitudinal ribs which intersect to form a grid pattern.

The edge of the cavity and the ribs are flush at the top to form a supporting surface for a mid-sole.

A major drawback of known shoe soles is the rigidity of the rear portion supporting the heel, which results in discomfort and, in the case of prolonged wear, in undue fatigue and even inflammation of the foot.

SUMMARY OF THE INVENTION

It is an object of the present invention to provide a shoe sole, particularly for sports shoes, designed to overcome the above drawback.

According to the present invention, there is provided a shoe sole comprising, integrally, a rear heel supporting portion and a front toe supporting portion; characterized in that at least said rear portion presents deformable supporting means at the top.

BRIEF DESCRIPTION OF THE DRAWINGS

A preferred, non-limiting embodiment of the present invention will be described by way of example with reference to accompanying drawings, in which.

DETAILED DESCRIPTION OF THE INVENTION

Figure 1:
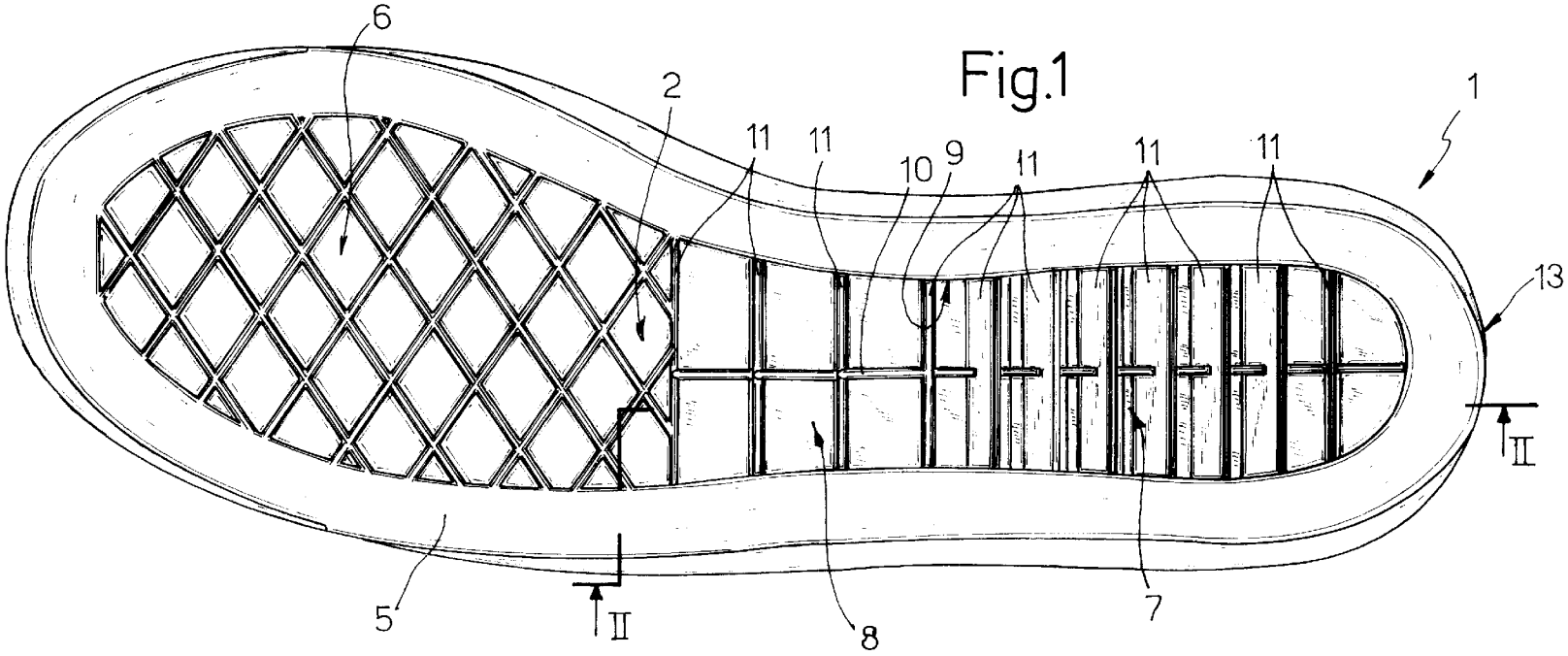
FIG. 1 shows a top plan view of a shoe sole in accordance with the of the present invention.

Number 1 in FIG. 1 indicates a sole for a sports shoe, in particular a hiking boot.

Figure 2:
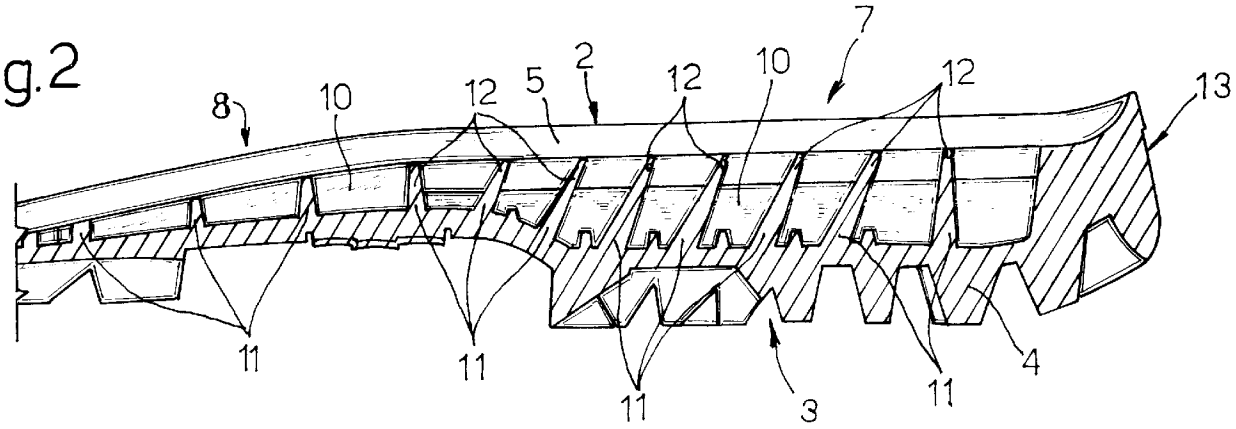
FIG. 2 shows an enlarged partial section along line II—II in FIG. 1.

As shown in FIGS. 1 and 2, sole 1 is made of rubber, and presents an upper face 2 designed to mate with a mid-sole; and a lower face 3 with a tread 4 designed to rest on the ground.

Upper face 2 is defined peripherally by a concave edge 5.

Sole 1 comprises, integrally, a front or toe portion 6; a rear or heel portion 7; and an intermediate portion 8 corresponding with the arch of the foot. At intermediate and rear portions 8 and 7, sole 1 presents, at the top, a cavity 9 defined laterally by raised edge 5, and in which are formed a central longitudinal rib 10 extending the full length of cavity 9, and a number of transverse ribs 11 extending between opposite lateral portions of edge 5, and which are flush at the top with edge 5, and intersect longitudinal rib 10 to form a grid pattern.

According to the present invention, longitudinal rib 10 in rear portion 7 is smaller in height, so that each transverse rib

11 presents an end portion 12 projecting upwards in relation to longitudinal rib 10, and which is deformable by the foot to act as a damper.

With the exception of the last one adjacent to the rear end 13 of sole 1, said ribs 11 slope upwards towards rear end 13 in relation to a vertical plane crosswise to sole 1.

When walking, projecting portions 12 of transverse ribs 11 flex towards rear end 13 of sole 1 under the pressure exerted by the heel when the foot is set down, and spring back to the undeformed position when thrust is exerted by the front portion of the foot. As such, rear portion 7 acts as a damper, i.e. shock absorber, for safeguarding against injury to the heel or Achilles tendon.

Moreover, according to the preferred embodiment of the invention described above, said function is achieved while maintaining the necessary height of rear portion 7, and with no reduction in the rigidity of sole 1.

Clearly, changes may be made to the sole as described and illustrated herein without, however, departing from the scope of the present invention.

For example, end portions 12 of transverse ribs 11 may slope towards intermediate portion 8 as opposed to rear end 13.

Sole 1 may also be applied to any type of shoe, e.g. sports shoes, casuals or walking shoes.

I claim:

1. A shoe sole comprising:

a front toe supporting portion of said sole formed integrally with a rear heel supporting portion of said sole, and a cavity formed in at least the rear heel supporting portion;

at least one first rib and a plurality of second ribs formed within said cavity, said second ribs intersecting said first rib to form a grid pattern and said second ribs having end portions projecting upwardly above said first rib at intersection thereof in said cavity to define deformable supporting means.

2. A shoe sole as claimed in claim 1, wherein said first rib extends longitudinally of said sole and said second ribs extend transversely to said first rib.

3. A shoe sole as claimed in claim 1, wherein at least one of said second ribs is inclined with respect to a vertical plane transverse to said sole and said first rib.

4. A shoe sole as claimed in claim 1, wherein said cavity is defined by a raised peripheral edge of said sole.

5. A shoe sole as claimed in claim 4, wherein said second ribs are flush at an upper edge thereof with said peripheral edge of said sole.

6. A shoe sole, comprising:

a front toe supporting portion of said sole formed integrally with a rear heel supporting portion of said sole, and a cavity formed in at least the rear heel supporting portion;

at least one first rib and a plurality of second ribs formed within said cavity, said second ribs intersecting said first rib to form a grid pattern and said second ribs having end portions projecting upwardly above a height of said first rib to define deformable supporting means;

wherein at least one of said second ribs is inclined with respect to a vertical plane transverse to said sole and said first rib;

wherein said inclined second rib is inclined upwardly and towards a rear end of said sole in relation to said vertical plane.

* * * * *

UNITED STATES PATENT AND TRADEMARK OFFICE

CERTIFICATE OF CORRECTION

PATENT NO. : 5,768,806

DATED : June 23, 1998

INVENTOR(S) : Davide PARISOTTO

It is certified that error appears in the above-identified patent and that said Letters Patent is hereby corrected as shown below:

On the cover page, at line [75], "Via Enrico Fermi" should be --Casella D'Asolo--; and at line [73], --S.p.A.-- should appear after "Calzaturificio S.C.A.R.P.A.".

Signed and Sealed this

Twelfth Day of January, 1999

*Attest:*

*Attesting Officer*

*Acting Commissioner of Patents and Trademarks*